US005752873A

United States Patent [19]

Morris

[11] Patent Number: 5,752,873

[45] Date of Patent: May 19, 1998

[54] ABDOMINAL SUPPORT AND SLIMMING GARMENT

[76] Inventor: Judith Ann Morris, 1285 W. Dallas St., Canton, Tex. 75103

[21] Appl. No.: 621,436

[22] Filed: Mar. 25, 1996

[51] Int. Cl.[6] ..... A41C 1/08

[52] U.S. Cl. ..... 450/122; 450/123; 450/125; 450/126; 450/155

[58] Field of Search ..... 2/44, 45, 310, 2/311, 312, 338, 237, 76, 92; 450/122, 123, 124, 125, 126, 127, 128, 129, 130, 131, 132, 133, 134, 135, 136, 137, 138, 139, 155

[56] References Cited

U.S. PATENT DOCUMENTS

| | | | |
|---|---|---|---|
| 903,626 | 11/1908 | Taylor | 450/155 X |
| 903,627 | 11/1908 | Taylor | 450/155 X |
| 1,391,563 | 9/1921 | Monin | 450/130 |
| 1,550,910 | 8/1925 | McNally | 450/136 |
| 2,310,864 | 2/1943 | Pegg | 450/122 |
| 2,445,322 | 7/1948 | Fridolph | 450/130 |
| 2,530,132 | 11/1950 | Silvain | 450/124 |
| 2,632,166 | 3/1953 | Sands | 450/134 X |
| 3,169,534 | 2/1965 | Grishman | 450/104 |
| 3,339,554 | 9/1967 | Nobbs | 450/104 |
| 3,441,027 | 4/1969 | Lehman | 450/134 X |
| 3,457,926 | 7/1969 | Bacon et al. | 2/237 |

FOREIGN PATENT DOCUMENTS

| | | | |
|---|---|---|---|
| 628690 | 10/1927 | France | 450/123 |
| 825863 | 3/1938 | France | 450/126 |

*Primary Examiner*—Jeanette E. Chapman
*Attorney, Agent, or Firm*—Robert Nisbett

[57] ABSTRACT

A garment accessory is provided by this invention which is typically built into the torso or waist area of an outer garment worn by a person. The accessory has a back panel attached at each side to a side panel. The side panel provides vertical stability and integrity for the accessory and garment. Attached to each side panel is at least one front panel. The two front panels cross each other and are removeably attached near the opposite side panel to provide uplifting and constraining forces for the torso of the wearer. The front panels comprise at least one band of elastic material removeably secured to the side panels at particular locations to provide the desired lift and constraining configuration.

18 Claims, 1 Drawing Sheet

ABDOMINAL SUPPORT AND SLIMMING GARMENT

CROSS REFERENCE TO RELATED APPLICATIONS

None

BACKGROUND AND PRIOR ART

Garment accessories have been suggested to provide support for the torso and especially the abdominal area of a person: however, previous accessories have been cumbersome and did not work effectively.

BRIEF SUMMARY OF INVENTION

The accessory of this invention provides support for the torso and especially the waist and abdominal area which effectively provides support for the abdomen, muscles and back and a slimming effect without being cumbersome and without the difficulties of having to wear a separate garment in addition to a garment such as one selected from jeans, shorts, briefs, trousers, pants, skirts, slacks, swim suits, athletic wear, and such like. The accessory of this invention is typically build into a garment and comprises a few simple parts arranged in a particular manner. The accessory of this invention comprises a back panel which passes laterally across the back of the torso near the waist, two side panels passing upwardly and downwardly near the side of the torso with one side panel attached to each end of the back panel, and two elastic front panels with one end attached at one fixed end to one of the side panels and with the opposite end of the said side panel removeably attached to an attachment point near the opposite side panel.

DETAILED DESCRIPTION OF INVENTION

Figure 7:
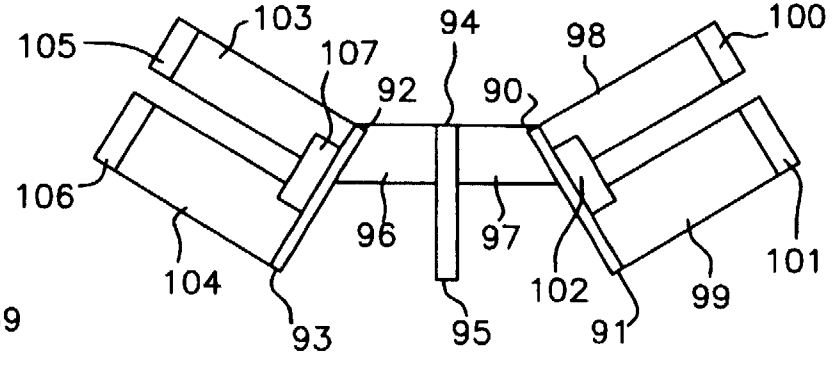
FIG. 7 is a layout or open view of another embodiment of the accessory of this invention showing the various parts and location thereof from the back.

The accessory of this invention can be part of the garment or it can be a separate garment such as a brief. The accessory is for providing form fitting support in garment such as one selected from jeans, shorts, briefs, trousers, pants, skirts, and such like. The accessory comprises a back panel which passes laterally across the back of the torso near the waist, two side panels passing upwardly and downwardly near the side of the torso with one side panel attached at each end of the back panel, and two elastic front panels each with one end attached at one fixed end to each side panel near the side of the torso and with the opposite or other end of said front panel removeably attached to an attachment point near the opposite side panel.

The accessory of this invention is typically built into the outer garment worn by a person, in which case, the back panel can be the same as the waist band or back portion of the garment and not necessarily a separate element of the garment. The back panel can be composed of a sturdy material which is the same type of material or a different type from that of the garment. The back panel can be a separate band of material which can also be the same type or a different type of material from that of the garment. One type of material which can be used for the back panel is one or more elastic bands which extend completely or partially across the back of the torso. Such elastic material can be used alone or in combination with bands or parts thereof made of other material. Materials which can be used include elastic, cotton fabric, synthetic fabric or combinations thereof The configuration and components of the back panel will vary with the type of garment with which the accessory is used. In some garments, the back panel will be of one continuous piece of fabric which extends from one side panel to the other. It may be rectangular in shape or two triangular pieces or combinations thereof. In other garments, the back panel can be split at some position such as the middle back seam of the garment to allow for placement of a zipper or other type of fastener or closure means.

The side panels of the accessory which are shown in FIGS. 1, 4, 5, 6 and 7 of the drawings as elongated rectangular shapes can be separate elements of the accessory and/or the garment with which the accessory is being worn or into which the accessory is built. The side panels can be the side seam of the garment into which the accessory is built or the side seam of an undergarment such a brief. The side panels extend upwardly and downwardly of the torso and accessory and garment. The side panels serve to hold the fixed ends of the back panel and the fixed and removeably attached ends of the front panels in a spaced arrangement to provide the proper constraining forces to support the abdomen, muscles, and back of the torso of the person wearing the accessory. The side panels can be composed of a relatively flat but rigid or semi-rigid material to provide this spaced arrangement. The side seam of most garments provide the necessary spacing for the accessory. In some garments, the other fabric of the garment such as the body of the garment also provides some integrity and spaced arrangement for the front and back panels of the accessory. The side panels can be made of the same type of materials as the back panel components.

The front panels comprise one or more elastic bands which are fixedly secured at one end to one side panel. The other or opposite end of each front panel is removeably attachable to an attachment point or material at or near the opposite side panel. Each front panel can be made up of one or more elastic bands. Other types of fabric and components can be used with each front panel to secure the ends of the panel at either end to the side panels. The front panels are positioned at the fixed attachment end and at the removeably attached end to provide the proper and necessary lift or constraining forces to provide the desired slimming effect and support for the abdomen, muscles, and back of the torso.

Generally, the front panels are arranged so that the two front panels cross each other and provide a lifting and constraining force uniformly across the abdomen and back of the torso, lifting the abdomen muscles and supporting the back. The removeably attached ends of the front panels can be attached in one of several upward or downward positions to provide the desired upward lift. The point of attachment of the removeably attached ends can also be adjusted to provide greater or lesser constraining forces. The adjustments are generally provided by the attachment means on the front panel and by the attachment point which is located on or near the opposite side panel. In one embodiment of the accessory, the removeably attachable end of each front panel is attached to the opposite attachment means near the upper end of the opposite attachment means so that the lower portion of the front panel provides an upward lift to the lower portion of the abdomen and the upper portion of the front panel provides a lateral constraining force across the abdomen. Each front panel can be composed of a single piece of elastic material which is wide enough to span the abdomen area to be lifted. The front panel can be rectangular in shape or it can be tapered with a narrow end at the removeably attachable end. The front panel can be shaped as a trapezoid or truncated triangle. In one embodiment, the front panel is composed of two or more elastic bands which can be removeably attached to the opposite attachment point independently or the two, or more, elastic bands can be fixed to each other at the removeably attachable end. In another embodiment each of the front panels can be composed of a single band of elastic which double across the abdomen with the each panel having the removeably attachable end at the fold of the single elastic band.

The attachment point which secures the moveable end of the front panel which is attached to the opposite side panel is located on a side panel or on the fixedly attached end of the opposite front panel. The attachment point can be composed of several types of material. Generally, it is a reinforced area of the accessory designed to secure the moveable end of a front panel but it also makes the removeably attachable end of a panel to be easily detached and/or move upward or downward relative to the side panel. The attachment means on a front panel and point of attachment near the opposite side panel can be selected from means such as hook and loop material, eye and hook means, loop and rod means, button and button holes, snaps, buckles, zipper means, or any other suitable removeably attachable mechanism. The hook and loop material such as Velcro material is one of the preferred attachment means. The loop and rod means could be a simple safety pin or several simple rod projections attached near the side panel with matching loops in the moveable end of the opposite front panel. Combinations of the attachment means could be used if desirable under some circumstances but the preferred embodiments would be simple, easily attached and detached means which provide the desired upward and downward adjustment in the point of attachment. The attachment means has the necessary matching attachment mechanism located at the attachment point shown in the drawings near the opposite side panel and at the removable end of a front panel to be attached at the attachment point.

The accessory of this invention can be easily seen as illustrated in the embodiments shown in the drawings. The drawings illustrate several embodiments and various components which in view of this disclosure could be modified, varied, or used in different combinations by one skilled in the art.

Figure 4:
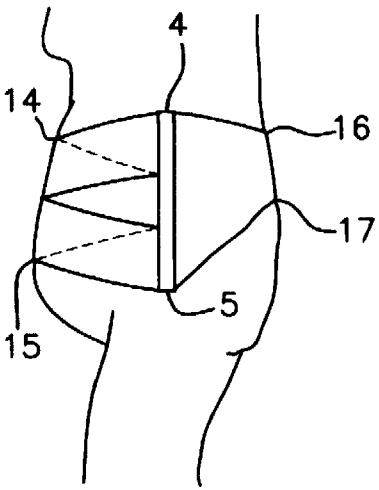
FIG. 4 is a representation of a left side view of the torso of a person showing positioning and use of one embodiment of the accessory of this invention.
Figure 3:
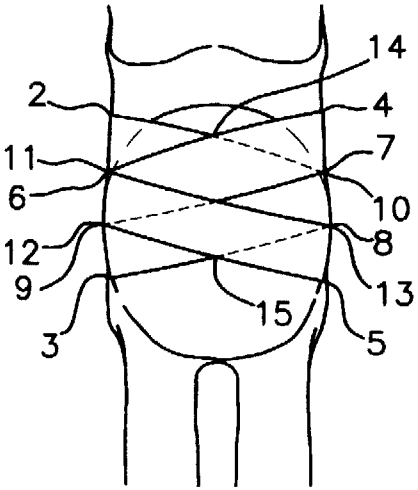
FIG. 3 is a representation of the front view of the torso of a person showing positioning and use of one embodiment of the accessory of this invention.
Figure 1:
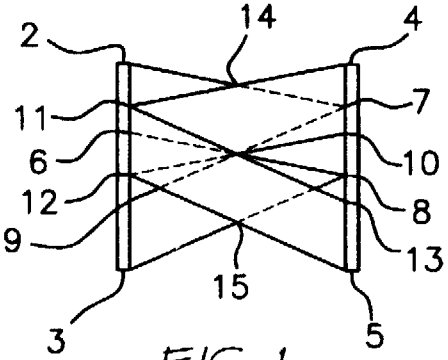
FIG. 1 is a front view of the one embodiment of the accessory of this invention showing the front panels attached to the both side panels.

FIG. 1 shows a front view of the accessory with two side panels and two front panels which cross each other at the mid point of the abdomen above the center of the accessory. The right side panel is indicated by numbers 2 and 3 at the top and bottom of the side panel. This is the right side panel from the perspective of the wearer as shown in FIGS. 3 and 4. The side panel 2-3 is shown as an elongated rectangle disposed in an upwardly and downwardly direction as it is positioned on the torso shown in FIGS. 3 and 4. The left side panel is indicated by numbers 4 and 5 in FIGS. 1, 3 and 4. It is also located in an upwardly and downwardly direction on the left side of the torso of the wearer. Attached to the right side panel near point 2 is a front panel which is indicated by numbers 2, 14, 7, 8, and 6. This right side front panel is shown folded at points 7 and 8 on the left side panel and extending back to the right at points 9 and 3. The right side front panel is shown attached to both side panels at the points indicated. The left side front panel is indicated by numbers 4, 10, 11, 12, 13 and 5. The bottom point of intersection of the two front panels is indicated by point 15. The front panels are designated right or left according to which side panel each is permanently attached. In FIGS. 1, 3 and 4 the left front panel is shown attached across the abdomen over the right front panel. If alternative attachment points and attachment means are provided, an accessory could be provided so that the either front panel could be attached first or under the other front panel. If only one arrangement of attachment points and attachment means are provided, the front panels of the accessory would be attached the same order or with the same front panel beneath the other front panel each time the accessory is worn. In FIG. 1, the accessory is shown with the attachment points of the front panels in an upward position on the side panels. In FIGS. 3 and 4, the attachment points of the front panels are shown in a symmetrical arrangement or attached to the opposite side panel near the mid-point of the opposite side panel. In FIG. 4, the back panel of the accessory shown from the left side of the torso is indicated by points 4, 16, 17 and 5.

Figure 2:
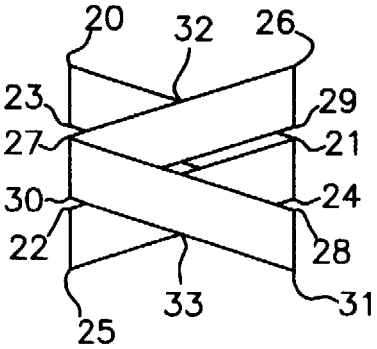
FIG. 2 is a front view of the accessory showing the position of the front panels in a closed position or with the front panels attached to side panels which are not shown in this view to simplify observation of the front panels in one embodiment.

FIG. 2 shows a simple or schematic arrangement of the front panels in a symmetrical arrangement. The front panels are shown with the opposite or removeably attachable ends located near the middle of the side panels. The top right front panel is indicated by numbers 20, 32, 21, 24 and 23. The bottom portion of the right front panel is indicated by numbers 21, 24, 33, 25 and 22. The right front panel is shown crossing the left front panel under the left front panel with the panels arranged symmetrically vertically and horizontally. In this arrangement the tension or forces in each portion of the front panels should be approximately the same as the forces in each other portion of the front panels. In FIG. 1, the attachment points of the front panels is located in an upward position on the side panels which should increase the tension or forces in the lower portions of each front panel. The forces in the different portions can also be varied by using different types of elastic for the different portions of the front panels and by using portions of elastic with different dimensions for the different parts of the front panels. For example, the forces in the lower portions of the front panels could be increased by using heavier or stronger elastic, by using portions of elastic having larger dimensions, by using several layers of elastic for the lower portion of the front panel, or by a combination of one or more of these features.

Figure 5:
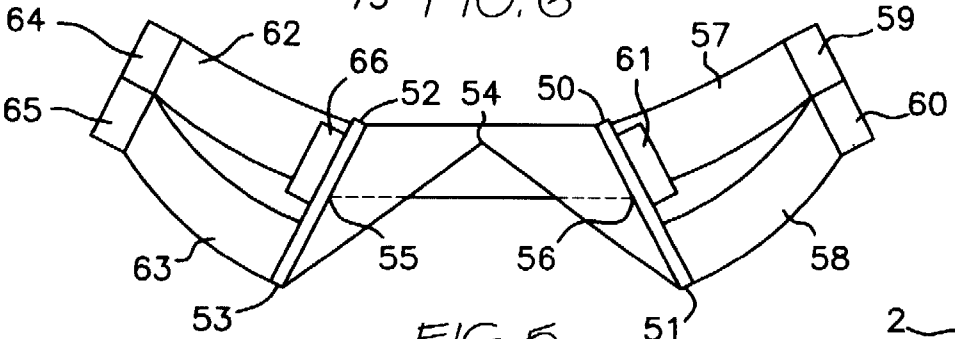
FIG. 5 is a layout or open view of one embodiment of the accessory of this invention showing the various parts from the back.

FIG. 5 shows another embodiment of the accessory from the back and in a layout or open position. A first part of the back panel is indicated by points 50, 51, 54, 53, and 52. A rectangular second part of the back panel is indicated by numbers 50, 56, 55 and 52. The back panel could be composed of either the first part or the second part alone. The first part is composed of two triangular or trapezoidal sections. Point 54 can be moved upward or downward in the configuration of the back panel to provide different arrangement of back support forces and to provide different distributions of the constraining forces provided by the front panels. In FIG. 5, the side panels are shown as elongated rectangular configurations. The side panels can be merely the side seams of the garment into which the accessory is fabricated, in which case the side panels would appear as elongated lines rather as a rectangular configuration. For other embodiments, the side panels can be elongated elements composed of material having a substantial amount of strength and providing a relatively rigid upward and downward spaced arrangement. The side panels should be relatively thin or flat so that the side panels do not appear bulky in the garment into which the accessory is built or with which it is being worm. The point of attachment for the opposite end of the front panel is shown as items 61 and 66. The point of attachment is shown as a rectangular shape which it typically can be if the attachment means is selected from hook and loop material or from hook and eye material. If a rod and loop means is used, one or more rod elements such as a safety pin mechanism would be attached to or near the side panel and loops of suitable size and material would be attached to the removable end of the opposite front panel so that the loops on the opposite front panel would slip over and onto the appropriate rod element to hold the front panel in place. The attachment points 61 and 66 can be located upward toward number 50 or downward toward number 51 on the side panel to provide the desired configuration for the accessory. With hook and loop attachment means such a Velcro material, additional adjustment is provided by the nature of the material. Hook and eye and other attachment means also provide some adjustment within the attachment means both vertically and horizontally. In FIG. 5, the front panels are shown having two bands each. The right front panel has upper band 57 and lower band 58. The left front panel has upper band 62 and lower band 63. Shown at the end of each band are attachment means 59, 60, 64 and 65 respectively. The attachment means are shown attached to each other so that they would be attached to the respective attachment points 61 and 66 as one unit but they can be separated and attached separately as would the bands and attachment means shown in FIG. 7. The accessory as shown in FIG. 5 would typically be built into the garment being worn or into a brief type garment. The garment would be put onto the torso as with any normal type of pants or skirt and the waist portion indicated by numbers 50 and 52 positioned near the waist of the torso. The front panels would next by attached to the opposite side panel by attaching the attachment means 59 and 60 to the attachment point 66 with the desired adjustment or tension. The other front panels 62 and 63 would next be attached to the opposite side panel by attaching the attachment means 64 and 65 to attachment point 61 with the desired tension and positioning. The attachment points as shown in FIG. 5 show relative location, with one front panel being place over the other side panel the attachment point would be located relative to the front or back of the side panels so that the attachment means of the opposite front panels would attach to it. For example, with the hook and loop attachment means, the attachment point would be located under one front panel and on top of the other side panel unless alternative attachment points are provided so that either front panel could be attached on top of the other front panel. The attachment points as shown could be arranged so that either side of the attachment points and either side of the attachment means could be used for attachment purposes. This would provide the alternative attachment arrangement for attachment of the front panels.

Figure 6:
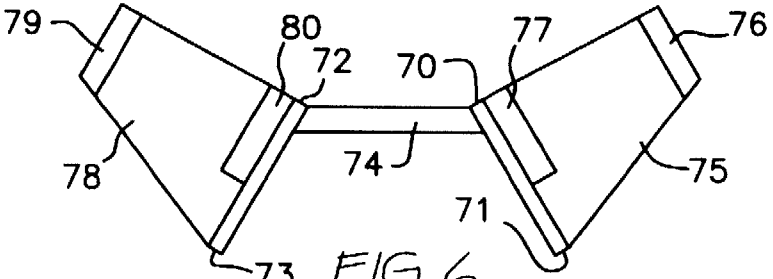
FIG. 6 is a layout or open view of another embodiment of the accessory of this invention showing the various parts and location thereof from the back.

FIG. 6 shows a layout or open view of another embodiment of the accessory of this invention. In this embodiment the back panel has a single trapezoid shape element shown as number 74. It is attached to side panels 70 and 72 near the top of each side panel. The front panels shown as numbers 75 and 78 are each a single portion of material arranged in a trapezoid shape with the attachment points shown as 76 and 79 respectively. The attachment points are shown as rectangular elements 77 and 80. In this embodiment the side panels would typically be attached to the garment into which it is built or with which it is being worn at the side seam of the garment so that the side panels are fixed in position relative to the garment.

FIG. 7 shows another embodiment of the accessory of this invention in a layout or open view from the back. In this embodiment the back panel is shown in two pieces 96 and 97 separated by element 94-95 which could be the back seam of the garment into which the accessory is built or it could be a closure means such as a zipper for securing the back panel or garment closed. The side panels are shown as rectangular elements 90-91 and 92-93. The front panels are shown each having two rectangular elements 98 and 99 and 103 and 104 respectively. Each rectangular element of the front panels has an attachment means located at the moveable end. Right front panel portions 98 and 99 has attachment means 100 and 101 respectively. Left front panel portions 103 and 104 has attachment means 105 and 106 respectively. Right front panel has an attachment point shown as 102 and left front panel has an attachment point shown as 107. In this embodiment each portion of the front panels could be attached and adjusted vertically and horizontally to provided the desired amount of lift and constraining forces for the abdomen, muscles, and back.

In one preferred embodiment similar to the embodiment shown in FIG. 5, the elastic bands of the front panels would use wide elastic at least three inches wide and having a rubber or elastomer content of at least 20%. The back panel would be typically of a length in the range of 10 to 28 inches. The back panel would have triangular or trapezoid shaped elements with the angular sides cut at approximately 45 degrees with the top of the back panel and the side panel. This angle could vary between 30 and 60 degrees with the side panel. The top of the back panel and the side panel would be disposed at an angle of approximately 90 degrees with respect to each other. The side seam or side panel would have a width in the range of 0.25 to 1.5 inches and the length could vary according to size and nature of the garment with which the accessory is used. Typically the length of the side panels or hip bands would be in the range of about 8 to 20 inches. The front panels would have a length in the range of about 10 to 28 inches. The front panels serve to provide balanced uplifting and constraining forces to support the abdominal muscles and support the back while producing a slimming effect and appearance.

I claim:

1. A slimming garment worn around the waist area of a person for supporting the abdominal area and torso comprising two elastic front panels having two ends and a back panel which passes laterally across the back of the torso near the waist, two side panels passing upwardly and downwardly near the side of the torso with one side panel fixedly attached to each end of the back panel and with the side panels adapted to hold the ends of the back panels and the ends of two front panels in a spaced arrangement providing a relatively rigid upward and downward spaced arrangement, and said two elastic front panels with one end of each elastic front panel fixedly attached at one end to one of the side panels and with the other end of said side panel having an attachment means which can be removeably attached to an attachment point at the opposite side panel so that the two front panels cross each other with the attachment means and attachment point adapted to allow the point of attachment to be adjusted at the side panel to provide a greater and lesser degree of constraining force and adjusted upwardly and downwardly to provide the desired degree of upward lift; and wherein each front panel is removeably, adjustably, attachable to each opposite side panel with the attachment point of each front panel being independently adjustable both horizontally and vertically at the opposite side panel and each side panel having alternative attachment means so that either front panel can be attached on top of the other front panel.

2. A garment of claim 1 wherein the back panel comprises one continuous piece of fabric.

3. A garment of claim 1 wherein the back panel comprises two trapezoid shaped pieces of fabric.

4. A garment of claim 1 wherein each side panel comprises the side seam of the garment.

5. A garment of claim 1 wherein the slimming garment is built into an outer garment that is worn by a person.

6. A garment of claim 1 wherein the slimming garment is built into a brief.

7. A garment of claim 1 wherein each front panel comprises one elastic band.

8. A garment of claim 1 wherein each front panel comprises one elastic band which doubles across the abdomen of the wearer.

9. A garment of claim 1 wherein each front panel comprises at least two elastic bands with points of removable, attachment which are independently adjustable.

10. A garment of claim 1 wherein each front panel comprises one elastic band which is tapered with the narrow end at the removeably attachable end.

11. A garment of claim 1 wherein each front panel comprises one elastic band which is rectangular in shape.

12. An accessory for providing form fitting support in a garment selected from jeans, trousers, pants, skirts and such like, comprising two elastic front panels having two ends and comprising a back panel which passes laterally across the back of the torso near the waist, two side panels passing upwardly and downwardly near the side of the torso with one side panel attached at each end of the back panel, and with the side panels adapted to hold the ends of the back panels and the ends of two front panels in a spaced arrangement providing a relatively rigid upward and downward spaced arrangement, and said two elastic front panels each with one end attached at one fixed end to each side panel near the side of the torso and with the other end of said front panel removeably attached to an attachment point near the opposite side panel so that the two front panels cross each other, with the attachment means and attachment point adapted to allow the point of attachment to be adjusted at the side panel to provide a greater and lesser degree of constraining force and adjusted upwardly and downwardly to provide the desired degree of upward lift, wherein each front panel is removeably, adjustably, attachable to each opposite side panel with the attachment point of each front panel being independently adjustable both horizontally and vertically at the opposite side panel.

13. A form fitting accessory of claim 12 wherein the back panel comprises two trapezoid shaped portions.

14. A form fitting accessory of claim 12 wherein each side panel comprises the side seam of the garment.

15. A form fitting accessory claim 12 wherein each front panel comprises one elastic band.

16. A garment of claim 12 wherein each front panel comprises one elastic band which doubles across the abdomen of the wearer.

17. A form fitting accessory of claim 12 wherein each front panel comprises at least two elastic bands.

18. A garment of claim 12 wherein each front panel is removeably, adjustably, attachable to each opposite side panel with the attachment point of each front panel being independently adjustable both horizontally and vertically at the opposite side panel and each side panel having alternative attachment means so that either front panel can be attached on top of the other front panel.

* * * * *